US006659822B1

(12) United States Patent
Dombeck

(10) Patent No.: US 6,659,822 B1
(45) Date of Patent: Dec. 9, 2003

(54) LAKE RAFT

(76) Inventor: Richard Dombeck, 1316 Joseph St., Box 789, Hawley, MN (US) 56549

( * ) Notice: Subject to any disclaimer, the term of this patent is extended or adjusted under 35 U.S.C. 154(b) by 0 days.

(21) Appl. No.: 10/187,961

(22) Filed: Jul. 3, 2002

(51) Int. Cl.[7] ..... B63B 35/58
(52) U.S. Cl. ..... 441/35; 441/36; 441/37
(58) Field of Search ..... 441/35, 36, 37, 441/129; 114/264

(56) References Cited

U.S. PATENT DOCUMENTS 3,363,272 A * 1/1968 Channon ..... 441/129
3,789,446 A * 2/1974 Rudelick ..... 441/39
3,921,239 A * 11/1975 Rudelick ..... 441/65
4,696,251 A 9/1987 Spieldiener et al.
4,766,918 A 8/1988 Odekirk
4,799,910 A 1/1989 Kellough
4,828,520 A 5/1989 Baughman et al.
4,974,538 A * 12/1990 Meriwether ..... 114/267
5,049,102 A 9/1991 Hull
5,275,860 A * 1/1994 D'Luzansky et al. ..... 428/71
5,403,220 A 4/1995 Goad, Sr.
5,518,431 A 5/1996 Staley
D393,683 S 4/1998 Song et al.
6,035,797 A * 3/2000 Robinson ..... 114/267
6,102,759 A 8/2000 Klimenko
6,312,054 B1 11/2001 Scheurer et al.

* cited by examiner

*Primary Examiner*—Sherman Basinger
(74) *Attorney, Agent, or Firm*—Richard C. Litman

(57) ABSTRACT

A light-weight, transportable raft to be utilized for recreational purposes. The raft is constructed of high-impact plastic material (polyethylene) and is sized to comfortably accommodate two people. Handles are conveniently located to make lifting and carrying easy. The raft is provided with a partially filled internal styrofoam core to maintain floatation and thus, does not require inflation before use. A soft, vinyl-covered ensolite mat is removably fastened to the top surface of the raft to enhance comfort. Safety features include high visibility color, an anchor housing, a battery operated night light, paddle holders and drain openings. Book holders, bottle holders and cooler holders are strategically arranged on the raft's surface.

14 Claims, 3 Drawing Sheets

LAKE RAFT

BACKGROUND OF THE INVENTION

1. Field of the Invention

The present invention generally relates to recreational equipment. More specifically, the present invention is drawn to a raft adapted for recreational use at lakes and the like.

2. Description of the Related Art

There are few moments more relaxing and enjoyable than the time spent leisurely floating on a raft at the lake. Enjoyment is enhanced if the rafter has access to accessories such as books, TV, radio, etc. Enjoyment is further enhanced if the rafter perceives that the raft is sturdy and includes devices to ensure safety. Al recreational raft which incorporates the above noted features and more, would certainly be a welcome addition to the art.

The prior art is rife with rafts of various persuasions. For example, U.S. Pat. No. Des. 393,683 (Song et al.) is drawn to a raft designed to accommodate two people. The raft is inflatable and is adapted to be propelled by oars. There is no indication that the raft is to function as a float for relaxing thereon.

U.S. Pat. Nos. 4,696,251 (Spieldiener et al.) and 5,518,431 (Staley) disclose circular floating devices adapted for recreational use. The devices are designed with chair-type seating arrangements and make no provision to include structure that retains multiple amenities.

U.S. Pat. Nos. 5,403,220 (Goad, Sr.) and 6,312,054 B1 (Scheurer et al.) show floating chairs adapted to support a single person thereon. As in the patents cited immediately above, the instant patents do not contemplate the provision of structure for containing multiple amenities.

A foldable recreational raft is shown in U.S. Pat. No. 5,049,102 (Hull). Clips are included for fastening a towel to the top side and plural pouches are formed in the body of the raft. A recess is formed in the top side of the raft for receiving a pillow.

U.S. Pat. Nos. 4,766,918 (Odekirk), 4,799,910 ((Kellough) and 4,828,520 (Baughman et al.) disclose rafts having shelters mounted thereon. The patentees are unconcerned with providing conveniences other than shelters.

U.S. Pat. No. 6,102,759 (Klimenko) is drawn to an inflatable raft having a single container structure therein.

None of the above inventions and patents, taken either singularly or in combination, is seen to disclose a recreational raft as will be subsequently described and claimed in the instant invention.

SUMMARY OF THE INVENTION

The present invention, to be dubbed Fun Raft, is drawn to a light-weight, transportable raft to be utilized for recreational purposes. The raft is constructed of high-impact plastic material (polyethylene) and is sized to comfortably accommodate two people. Handles are conveniently located to make lifting and carrying easy. Unlike most rafts, Fun Raft is provided with a partially filled internal styrofoam core to maintain floatation and thus, does not require inflation before use. This construction also eliminates the danger of an accidental puncture which would cause the raft to deflate and sink. A soft, vinyl-covered ensolite mat is removably fastened to the top surface of the raft to enhance comfort. Features such as high visibility color, reflectors, an anchor housing, night light, paddle holders and drain openings instill confidence as to the safety of the raft. Book holders, bottle holders, cooler holders, etc. are strategically arranged on the[0ax2]aft's surface to insure that the rafting experience will be a fun[0a‰5]xperience.

Accordingly, it is a principal object of the invention to provide a raft adapted for recreational use.

It is another object of the invention to provide a recreational raft which is light-weight and portable.

It is a further object of the invention to provide al recreational raft which is safe.

Still another object of the invention is to provide a recreational raft which incorporates plural leisure conveniences.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
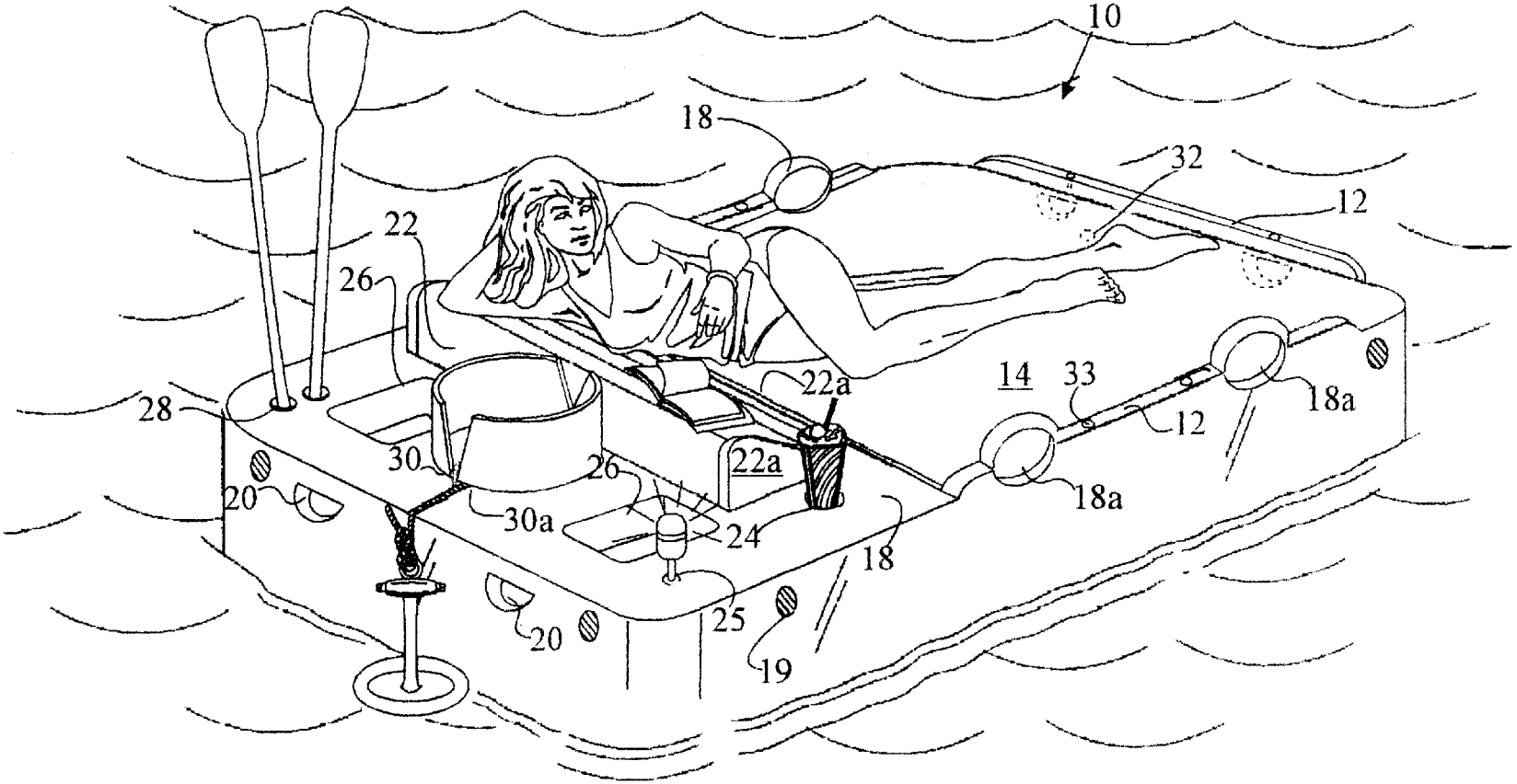
FIG. 1 is an environmental, perspective view of a lake raft according to the present invention.

Attention is first directed to FIG. 1 wherein the Fun Raft is generally indicated at 10. Raft 10 is fabricated from one-piece, high-impact plastic material. Although polyethylene is preferred, any suitable, sturdy plastic material could be used. Raft 10 is approximately eight feet long and four feet wide defining an area that will comfortably accommodate two people. The sides and back end of the raft extend above the top surface forming a rim 12 around the perimeter. Rim 12 is slightly rounded at the top for comfort and safety. The rim is discontinued at the corners to provide drain openings or breaks. Expansion and contraction air holes 33 are positioned at the top of the rim to prevent the raft from cracking. A mat 14 is disposed on the upper surface of raft 10. Mat 14 is fabricated from a soft, water repellant fabric i.e. ensolite and is removably attached to the raft's surface with hook and loop fasteners 16 (FIG. 2) or the like. Rim 12 will also assist in holding mat 14 in place.

Handles 18 are positioned on the sides of the raft. Handles 18 are fashioned with open areas 18*a*. Open areas 18*a* have one edge thereof substantially flush with the surface of the mat so that water may efficiently drain from the mat's surface. Handles 18 function as holds while swimming and as means to tie down the raft for storage and travel. Additional handles 20 are imbedded in the front and rear ends of the raft. Handles 20 are employed to carry the raft and for tie down. Embedded handles 20 lessen the chance of damage when the raft is being carried.

The upper surface of Fun Raft is awash with amenities. A book holder/entertainment holder 22 is disposed at the front of the raft. Holder 22 is fashioned with a forty-five degree surface to support a book, magazine or TV at a comfortable viewing angle. Raised edges 22*a* prevent items from sliding off and falling into the water. At least two openings 24 (only one is shown) are utilized to hold standard beverage cups or cans. Openings 26 are sized to support coolers therein.

Figure 2:
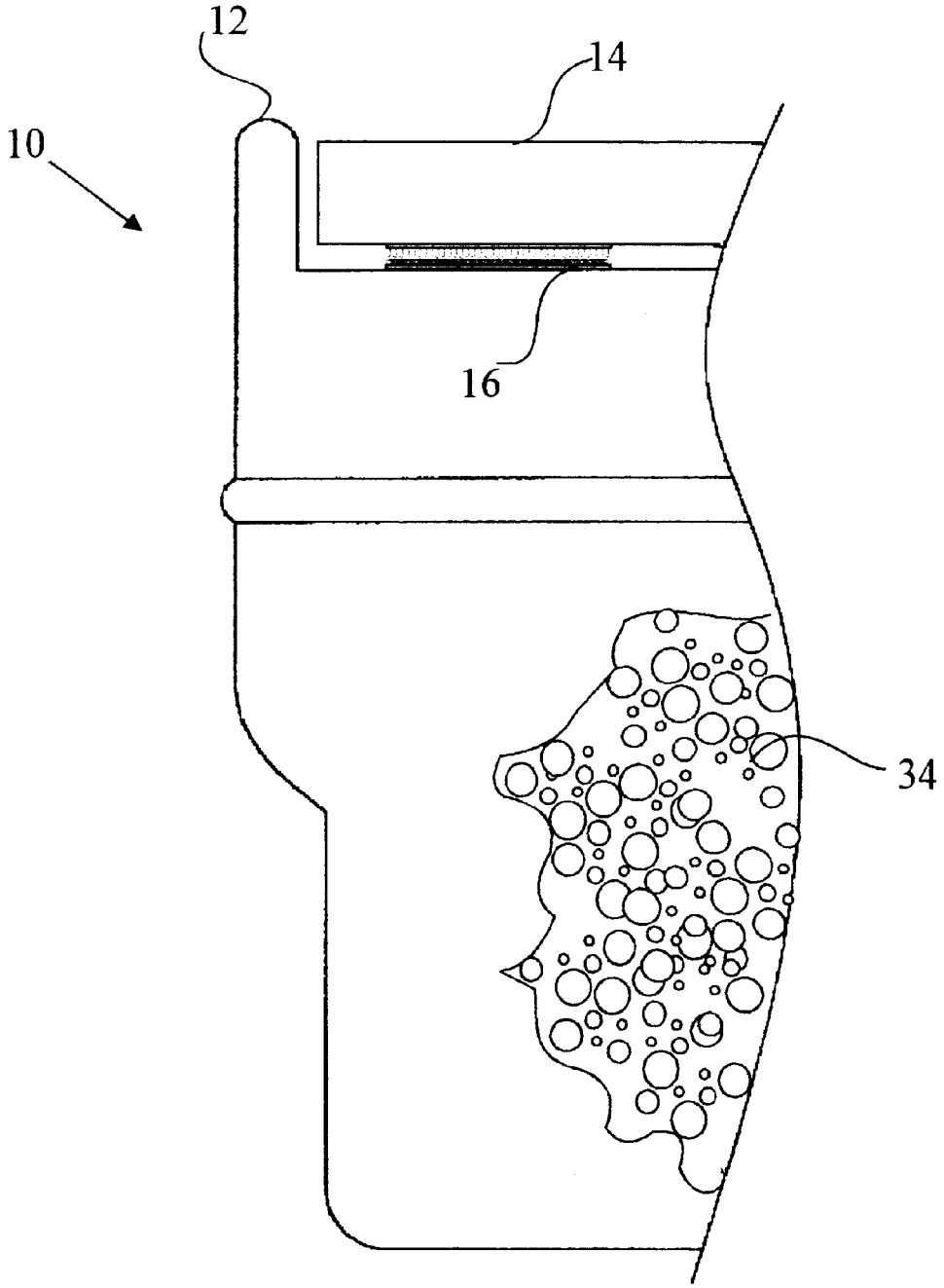
FIG. 2 is a partial end view of a lake raft according to the present invention.

Safety features include a three-quarter inch by three inch opening 25 adapted to hold a battery operated light for night use. Reflectors 19. A pair of openings 28 receive paddles so that the raft may be safely propelled if desired. A cylindrical member 30 having a diametric V-shaped opening 30*a* functions as a rope guide and anchor holder. At least one drain hole and plug 32 is positioned at the rear end of the raft should the raft need to be drained. As best seen in FIG. 2, the interior volume of the raft is partially filled with styrofoam 34 or the like, thereby making the raft virtually unsinkable.

Figure 3:
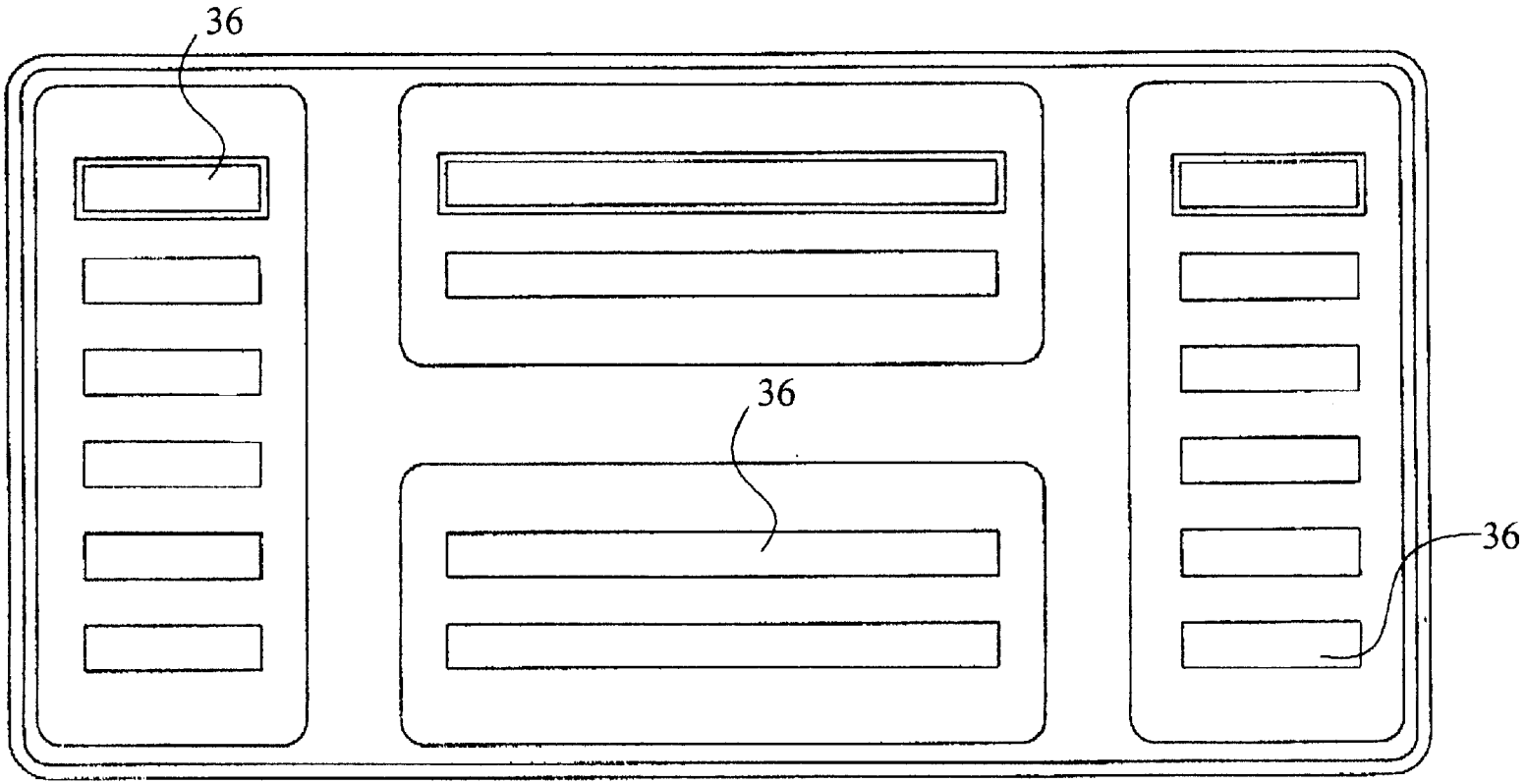
FIG. 3 is a bottom view of a lake raft according to the present invention.

The bottom surface of the raft (FIG. 3) is designed with multiple three inch wide runners 36, which runners are strategically arranged to insure stability and maneuverability.

It is to be understood that the present invention is not limited to the embodiment described above, but encompasses any and all embodiments within the scope of the following claims.

I claim:

1. A recreational raft including:

a one-piece body member, said body member having a hollow interior;

a front end wall, a rear end wall, an upper surface, a lower surface and a pair of side walls defining said one-piece body member;

an upstanding rim, said rim formed on said upper surface and extending substantially around said pair of sidewalls and said rear end wall, wherein said rear end wall includes two corner areas and said upstanding rim is discontinued at said two corner areas;

a solid floatation material, said floatation material disposed in and partially filling said hollow interior of said body member;

a mat fabricated from a soft, supple material, said mat removably attached to said upper surface;

a plurality of runners, said plurality of runners positioned on said lower surface;

an array of safety and convenience devices disposed on said upper surface; and at least four handles formed in said rim, said handles having open areas for draining water from said upper surface.

2. A recreational raft as recited in claim 1, wherein said array of convenience devices include:

at least one cup receptacle, at least one cooler receptacle, and a support member for books and magazines.

3. A recreational raft as recited in claim 2, wherein said support member includes a support surface having an angle of forty-five degrees.

4. A recreational raft as recited in claim 3, wherein said array of safety devices include:

at least one night light receptacle, at least one paddle receptacle and a rope guide and anchor holder.

5. A recreational raft as recited in claim 4, wherein said rope guide and anchor holder is a cylindrical member having a diametrical V-shaped opening therein.

6. A recreational raft as recited in claim 5, wherein said solid floatation material is styrofoam.

7. A recreational raft as recited in claim 6, wherein said body member is fabricated from polyethylene.

8. A recreational raft including:

a one-piece body member fabricated from a plastic material, said body member having a hollow interior;

a front end wall, a rear end wall, an upper surface, a lower surface and a pair of side walls defining said one-piece body member;

an upstanding rim, said rim formed on said upper surface and extending substantially around said pair of sidewalls and said rear end wall, wherein said rear end wall includes two corner areas and said upstanding rim is discontinued at said two corner areas;

a solid floatation material, said floatation material disposed in and partially filling said hollow interior of said body member;

a plurality of runners, said plurality of runners positioned on said lower surface;

a pair of handles imbedded in each said front end wall and said rear end wall;

a mat fabricated from a soft, supple material, said mat removably attached to said upper surface; an array of safety and convenience devices disposed on said upper surface; and at least four handles formed in said rim, said handles having open areas for draining water from said upper surface.

9. A recreational raft as recited in claim 8, wherein said array of convenience devices include:

at least one cup receptacle, at least one cooler receptacle, and a support member for books and magazines.

10. A recreational raft as recited in claim 9, wherein said support member includes a support surface having an angle of forty-five degrees.

11. A recreational raft as recited in claim 10 wherein said array of safety devices include:

at least one night light receptacle, at least one paddle receptacle and a rope guide and anchor holder.

12. A recreational raft as recited in claim 11, wherein said rope guide and anchor holder is a cylindrical member having a diametrical V-shaped opening therein.

13. A recreational raft as recited in claim 12, wherein said solid floatation material is styrofoam.

14. A recreational raft as recited in claim 13, wherein said body member is fabricated from polyethylene.

* * * * *